US012473743B2

(12) United States Patent
Dorward

(10) Patent No.: US 12,473,743 B2
(45) Date of Patent: Nov. 18, 2025

(54) OPEN-FRAME FOUNDATION APPARATUS FOR POST SUPPORT

(71) Applicant: Saudi Arabian Oil Company, Dhahran (SA)

(72) Inventor: Scott Garnet Dorward, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 288 days.

(21) Appl. No.: 18/297,967

(22) Filed: Apr. 10, 2023

(65) Prior Publication Data

US 2024/0337131 A1 Oct. 10, 2024

(51) Int. Cl.
*E04H 12/22* (2006.01)

(52) U.S. Cl.
CPC ..... *E04H 12/2284* (2013.01); *E04H 12/2238* (2013.01)

(58) Field of Classification Search
CPC . E04H 12/22; E04H 12/2269; E04H 12/2238; E04H 12/2284; E01F 9/685
See application file for complete search history.

(56) References Cited

U.S. PATENT DOCUMENTS

| | | | | | |
|---|---|---|---|---|---|
| 4,972,642 | A * | 11/1990 | Strobl, Jr. | E02D 27/42 | 52/165 |
| 5,271,196 | A * | 12/1993 | Fanti | E04H 12/22 | 52/165 |
| 5,524,855 | A | 6/1996 | Lesar | | |
| 5,636,944 | A * | 6/1997 | Buttimore | E01F 9/685 | 52/298 |
| 6,511,033 | B2 * | 1/2003 | Li | A45B 23/00 | 248/519 |
| 6,729,089 | B1 * | 5/2004 | Spragg | E04H 12/2238 | 248/346.03 |
| 8,082,702 | B2 | 12/2011 | Hill | | |
| 9,777,456 | B1 * | 10/2017 | Spiro | E04H 12/2284 | |
| 11,377,866 | B1 * | 7/2022 | Conlon | A45B 23/00 | |
| D962,630 | S * | 9/2022 | Conlon | D3/10 | |
| D1,054,689 | S * | 12/2024 | Conlon | D3/10 | |
| 2015/0368923 | A1 | 12/2015 | Smith | | |
| 2016/0279494 | A1 * | 9/2016 | Paul | A63B 71/0045 | |

FOREIGN PATENT DOCUMENTS

| | | | | |
|---|---|---|---|---|
| ES | 2276566 | A1 * | 6/2007 | E04H 17/22 |
| GB | 2435484 | A * | 8/2007 | E04H 12/2269 |
| KR | 101166141 | | 7/2012 | |
| NL | 1003089 | C2 * | 11/1997 | E01F 9/692 |
| WO | WO 2017137652 | | 8/2017 | |

* cited by examiner

*Primary Examiner* — Adriana Figueroa
(74) *Attorney, Agent, or Firm* — Fish & Richardson P.C.

(57) ABSTRACT

An open-frame foundation apparatus for post support includes a hollow tube that includes a wall having an outer surface. The apparatus includes four fin members, each having a quadrilateral shape. A respective first edge of each fin member is attached to the outer surface of the wall of the hollow tube. Each fin member extends radially away from the outer surface of the wall of the hollow tube. The apparatus includes a quadrilateral prism member surrounding the hollow tube and the four fin members. A second edge of each fin member is attached to a corresponding edge of the quadrilateral prism member. Two adjacent fin members are connected by two other edges of the quadrilateral prism member.

17 Claims, 12 Drawing Sheets

OPEN-FRAME FOUNDATION APPARATUS FOR POST SUPPORT

TECHNICAL FIELD

This disclosure relates to anchor systems to receive and support vertical structures such as signs, posts, and the like.

BACKGROUND

A structure such as a street sign, a small light stand, an instrument stand pipe, or the like, includes a tubular portion that is attached to or makes up a bottom half of the structure. The top half of the structure can be larger or bulkier than the tubular portion. Such structures can be vertically positioned by anchoring the tubular portion into the ground. For example, a hole can be formed in the ground and the tubular portion can be positioned in the hole. Alternatively or in addition, a base can be positioned in the ground and the tubular portion can be inserted into the base. In some situations, the base can be positioned on the ground (rather than in the ground). The base serves as an anchor system or as a foundation apparatus for the tubular portion and supports the vertical orientation of the structure.

SUMMARY

This disclosure describes technologies relating to an open frame foundation apparatus for post support.

Certain aspects of the subject matter described here can be implemented as an apparatus. The apparatus includes a hollow tube that includes a wall having an outer surface. The apparatus includes four fin members, each having a quadrilateral shape. A respective first edge of each fin member is attached to the outer surface of the wall of the hollow tube. Each fin member extends radially away from the outer surface of the wall of the hollow tube. The apparatus includes a quadrilateral prism member surrounding the hollow tube and the four fin members. A second edge of each fin member is attached to a corresponding edge of the quadrilateral prism member. Two adjacent fin members are connected by two other edges of the quadrilateral prism member.

An aspect combinable with any other aspect includes the following features. The hollow tube, the four fin members and the quadrilateral prism member are made from fiber-reinforced polymer.

An aspect combinable with any other aspect includes the following features. Each fin member is attached on the outer surface of the wall at 90 degree offsets from each other.

An aspect combinable with any other aspect includes the following features. Each fin member has a rectangular shape. The first edge of each fin member is of the same length as the second edge of each fin member.

An aspect combinable with any other aspect includes the following features. Each fin member has a trapezoidal shape. The first edge of each fin member is shorter in length than the second edge of each fin member.

An aspect combinable with any other aspect includes the following features. A length of the tube is less than a height of the quadrilateral prism member.

An aspect combinable with any other aspect includes the following features. The quadrilateral prism is a right angle, rectangular prism.

An aspect combinable with any other aspect includes the following features. The quadrilateral prism is a right angle, rhombus prism.

An aspect combinable with any other aspect includes the following features. Faces of the quadrilateral prism are void of material.

Certain aspects of the subject matter described here can be implemented as a method. A hollow tube including a wall is formed using fiber reinforced polymer. Four fin members are formed using the fiber reinforced polymer. Each fin member is formed in a quadrilateral shape. A respective first edge of each fin member is attached to the outer surface of the wall of the hollow tube such that each fin member extends radially away from the outer surface of the wall of the hollow tube. A quadrilateral prism member is formed surrounding the hollow tube and the four fin members. To do so, a second edge of each fin member is attached to a corresponding edge of the quadrilateral prism member made using the fiber reinforced polymer. Two adjacent fin members of the quadrilateral prism member are attached to two other edges of the quadrilateral prism member. Each of the two other edges are made using the fiber reinforced polymer.

An aspect combinable with any other aspect includes the following features. To attach the respective first edge of each fin member to the outer surface of the wall of the hollow tube, each fin member is attached on the outer surface of the wall at 90 degree offsets from each other.

An aspect combinable with any other aspect includes the following features. Each fin member is formed in a rectangular shape. The first edge of each fin member is of the same length as the second edge of each fin member.

An aspect combinable with any other aspect includes the following features. Each fin member is formed in a trapezoidal shape. The first edge of each fin member is shorter in length than the second edge of each fin member.

An aspect combinable with any other aspect includes the following features. The tube is formed to a length less than a height of the quadrilateral prism member.

An aspect combinable with any other aspect includes the following features. The quadrilateral prism member is positioned on the ground with the tube oriented vertically with reference to the ground. A tubular portion of a structure is inserted into the tube. The structure is to be anchored to the earth at a location of the hole.

An aspect combinable with any other aspect includes the following features. To position the quadrilateral prism on the ground, a hole is dug in the ground. The quadrilateral prism member is positioned within the hole. The tube is oriented vertically within the hole. The hole is packed with cohesionless soil.

An aspect combinable with any other aspect includes the following features. The structure is a disc golf basket.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes an open-frame foundation apparatus (or anchor) to support structures in vertical orientations. Such structures can include signs (such as street signs), light stands, instrument stand pipes or other structures that have a tubular portion that needs to be vertically oriented, such as the post of a disc golf basket. The apparatus described here can serve to anchor the tubular portion into the ground (e.g., in a hole dug in the Earth) or as a base positioned on (i.e., above) the ground and into which the tubular portion can be inserted.

FIGS. 1A-1D are views of an example of an open frame foundation apparatus 100. The apparatus 100 includes a hollow tube 102 having a wall 104 with an outer surface 106. In some implementations, the hollow tube 102 can have a cylindrical cross-section. Alternatively, the hollow tube 102 can have an internal cross-section that matches an external cross-section of the tubular portion of the structure for which the apparatus 100 is meant to serve as an anchor, base or foundation. In some implementations, the hollow tube 102 can have an internal cross-section of one geometry (e.g., circular or rectangular) and an external cross-section of a different geometry (e.g., rectangular or circular).

Figure 3A:
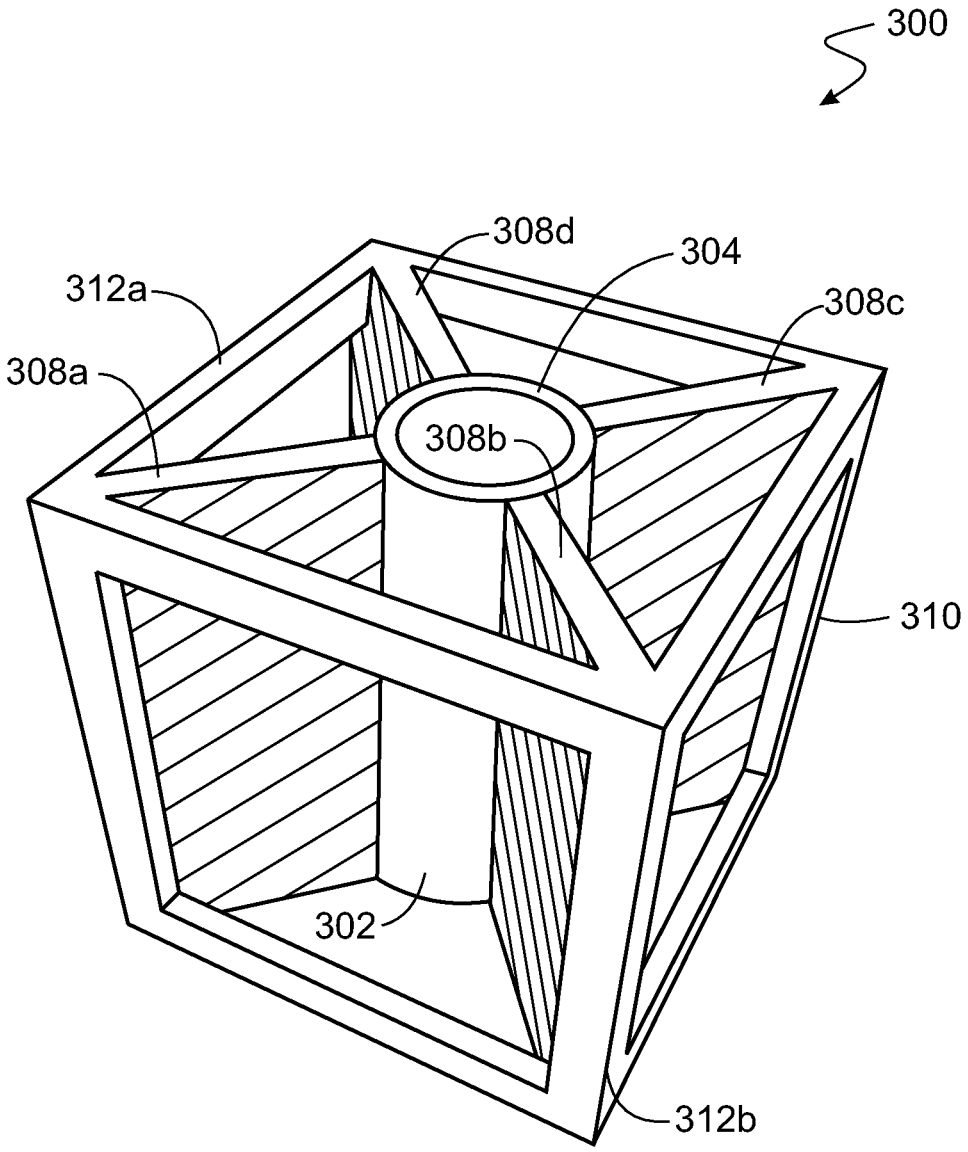
FIGS. 3A-3D are views of an example of an open frame foundation apparatus.
Figure 3B:
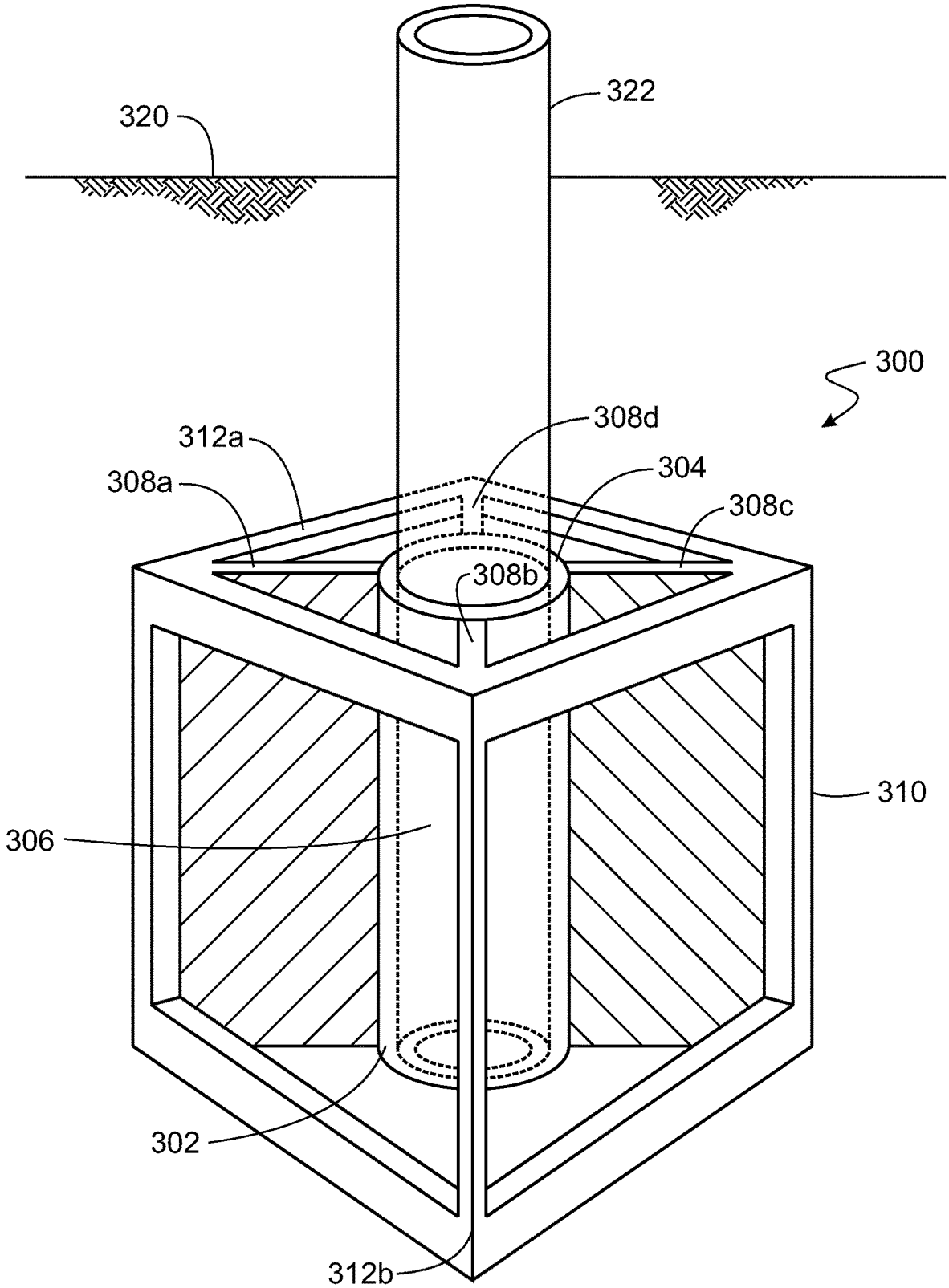
Figure 3C:
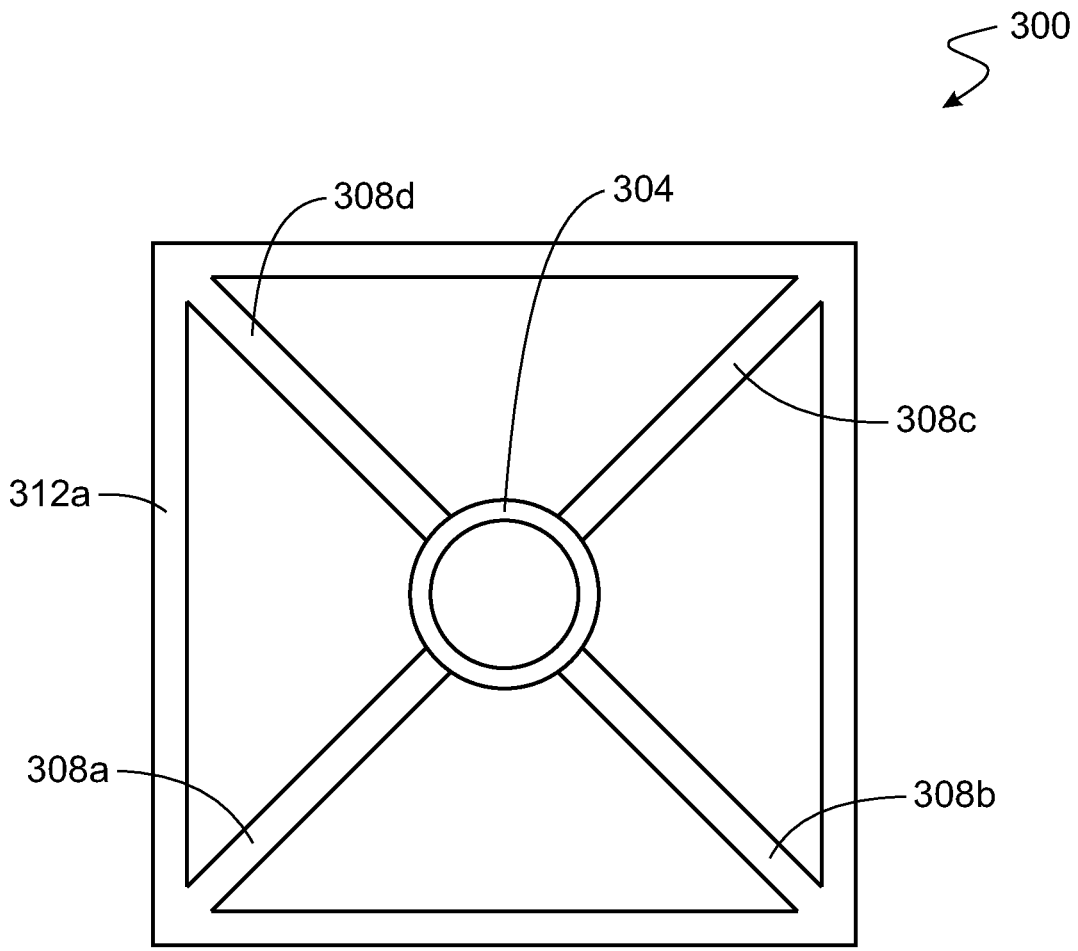
Figure 3D:
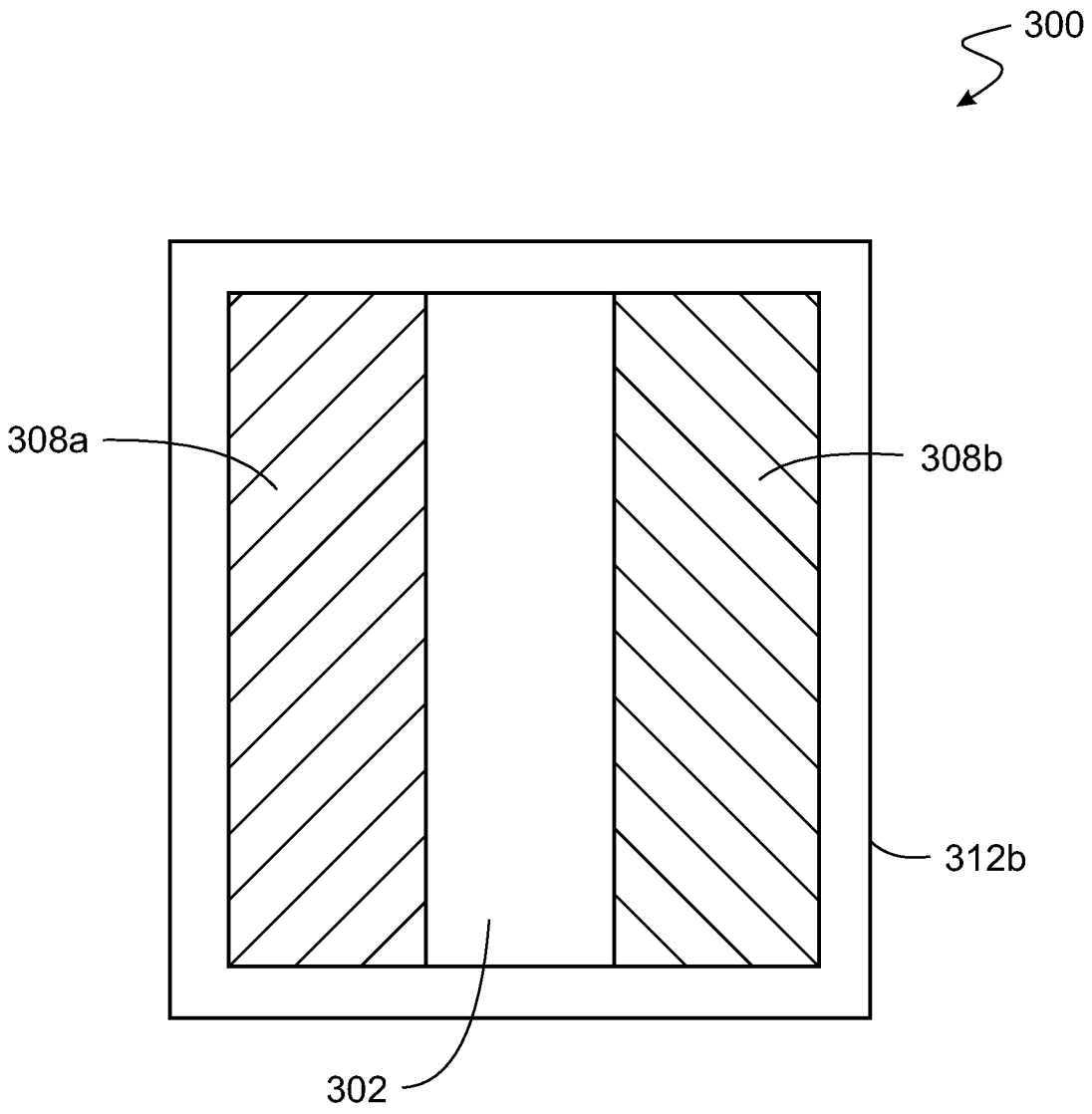

The apparatus 100 includes four fin members (members 108*a*, 108*b*, 108*c*, 108*d*). Each fin member has a quadrilateral shape. A respective first edge of each fin member is attached to the outer surface 106 of the wall 104 of the hollow tube 102. With the first edge attached to the outer surface 106, each fin member extends radially away from the hollow tube 100. FIGS. 3A and 3B are views of examples of components of open frame foundation apparatus, specifically the fin members. FIG. 3A shows a fin member 202 having a trapezoidal geometry. The fin member 202 has two parallel edges or sides—204*a*, 204*b*. Edge 204*a* is shorter in length compared to edge 204*b*. Edge 204*a* is attached to the outer surface 106 of the wall 104. When the fin member 202 with the trapezoidal geometry is implemented, the hollow tube 102 can have a shorter length than the edge 204*b*. FIG. 3B shows a fin member 212 having a rectangular geometry. The fin member 212 has two parallel edges or sides—214*a*, 214*b*—both of the same length. When the fin member 212 with the rectangular geometry is implemented, the hollow tube 102 can have the same length as the edge 214*a*. In some implementations, the hollow tube 102 can be longer or shorter than the longer of the two parallel edges of the fin member regardless of fin member geometry.

Each fin member is a 3-dimensional structure having a thickness. In some implementations, the edge of the fin member (e.g., edge 204*a* for fin member 202, or edge 214*a* for fin member 212) can have a wall that is shaped like the outer surface 106 of the tube 102. For example, where the outer surface 106 is cylindrical, the wall of the edge 214*a* can have a complementary curved shape that matches the curvature of the cylindrical outer surface 106. The surface that connects the two edges of the fin member (e.g., edges 204*a*, 204*b* for fin member 202, or edges 214*a*, 214*b* for fin member 212) can be filled with material, i.e., solid, or not open, or not void of material. Such a construction allows each fin member to act as a diaphragm to distribute forces from the tube 102 to a quadrilateral prism member 110 (described below). In some implementations, the four fin members are offset by 90 degrees along the circumference of outer surface 106 of the wall 104.

A quadrilateral prism member 110 surrounds the hollow tube 100 and the four fin members. The tube 102 is positioned in the geometric center of the prism member 110. The quadrilateral prism member 110 includes multiple edges or sides (for example, edge 112*a*, 112*b*). In some implementations, a length of an edge is seven times the diameter of the tube 102. When the tube 102 is positioned within the prism member 110 and the edges of the fin members are connected to edges of the prism member 110, the tube 102 is perpendicular to four edges (e.g., 112*a*) of the prism member 110 and parallel to four other edges (e.g., edge 112*b*) of the prism member 110. Each edge of each fin member is attached in its respective entirety to a corresponding edge of the prism member 110, specifically to the edge that is parallel to the tube 102. Two adjacent fin members are connected by two other edges of the prism member 110. For example, the edge 112*a* of the prism member 110 connects a vertex of one fin member to a vertex of another, circumferentially offset fin member.

In some implementations, the face formed by the vertices of four edges can be open. That is, the face is formed only by the four edges with a void (or open space) in the volume between the four open faces. A benefit of such a design is savings in a quantity of material needed to make the apparatus 100. In some implementations, the face formed by the vertices can be closed. That is, the apparatus 100 is constructed like a box with closed side faces, where a side face is a face of the prism member 110 that is parallel to the tube 102. The top and bottom faces (i.e., the faces perpendicular to the tube 102) can be closed with openings in each face to pass a tubular portion of the structure to be supported, through the openings and into the tube 102. In another construction, the top face can be open and only the bottom face can be closed. The added weight in such closed or semi-closed constructions can serve to strengthen the foundation for supporting the structure, especially when the apparatus 100 is used above ground.

Figure 1A:
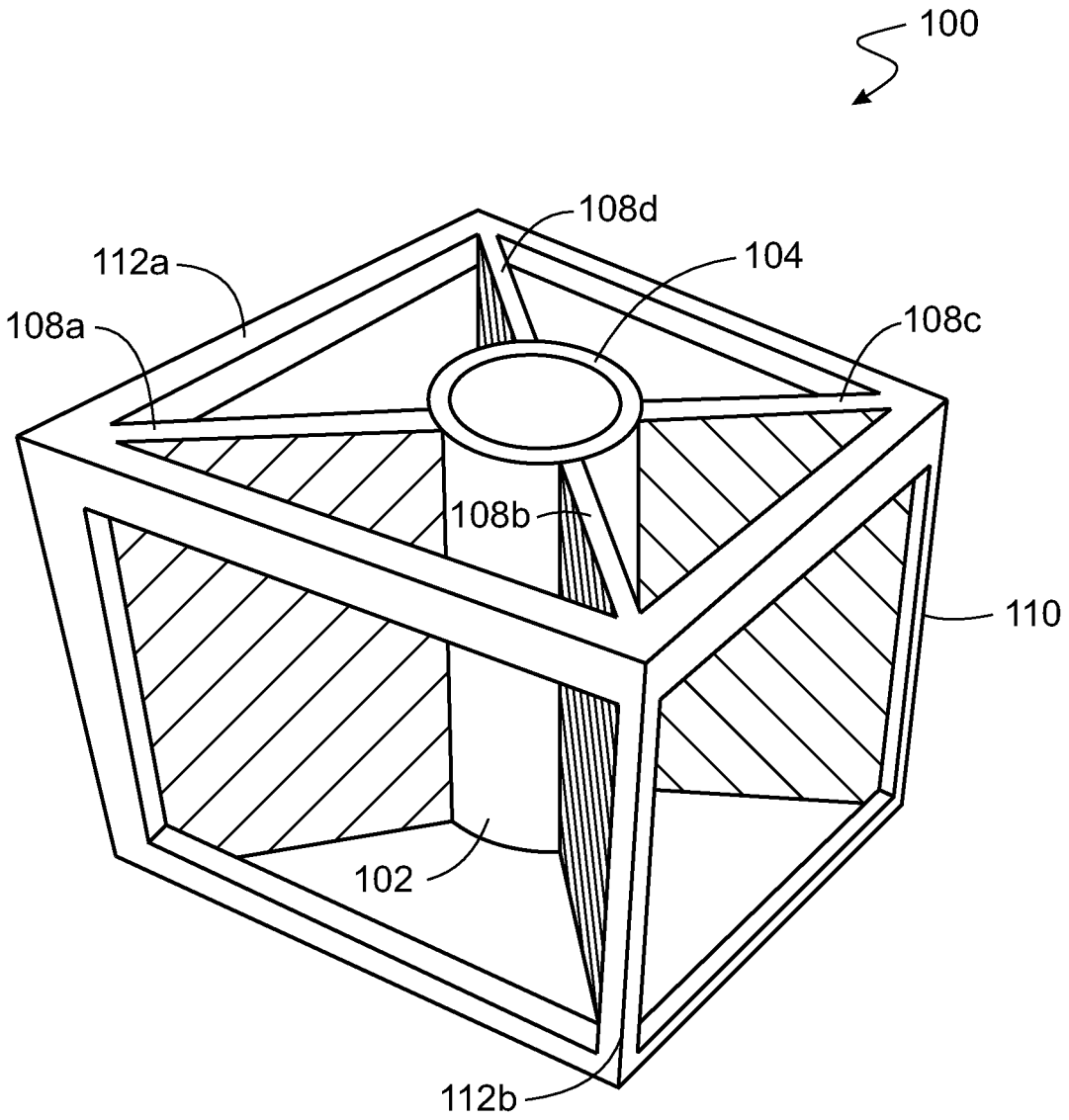
FIGS. 1A-1D are views of an example of an open frame foundation apparatus.
Figure 1B:
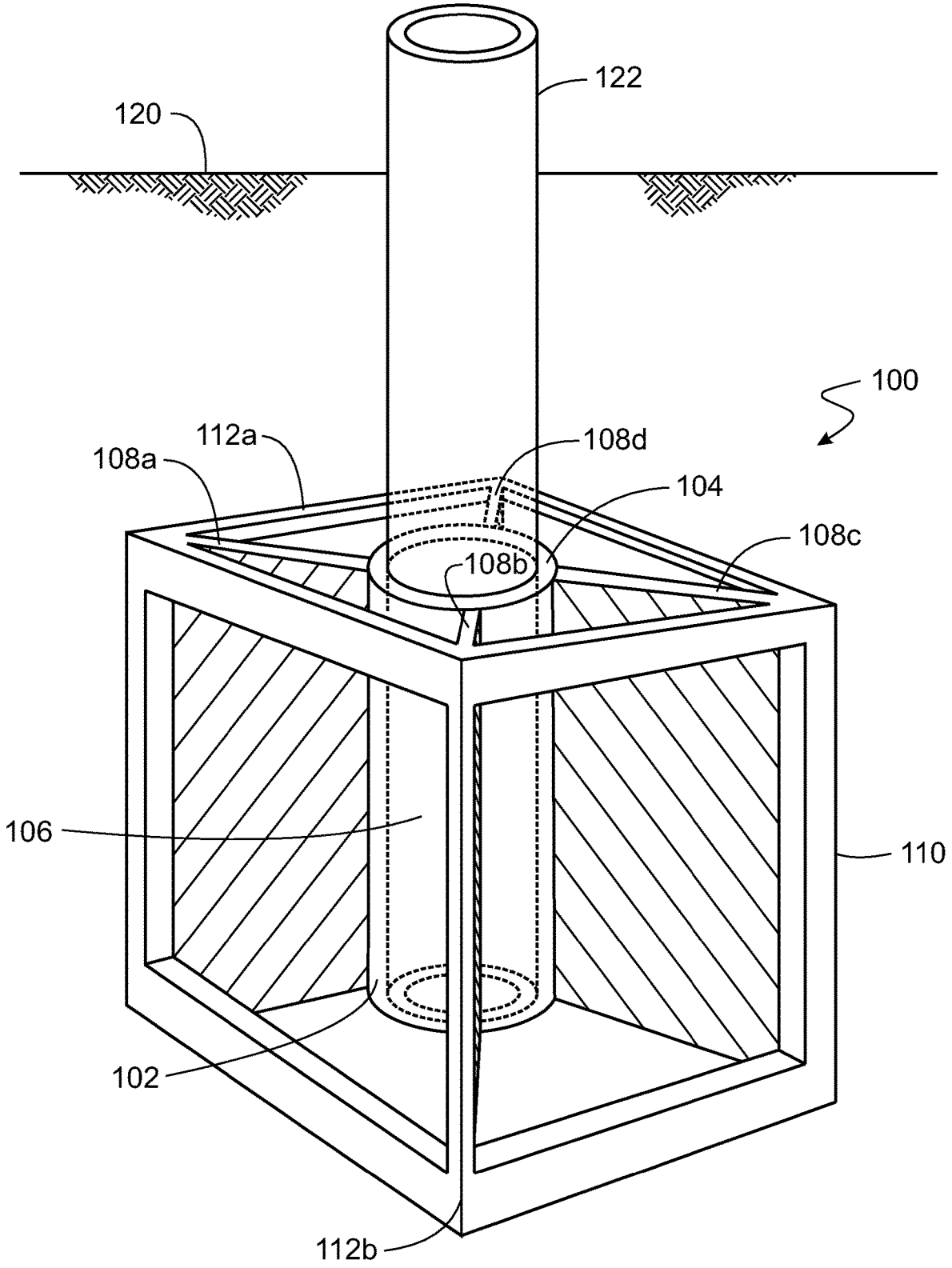
Figure 1C:
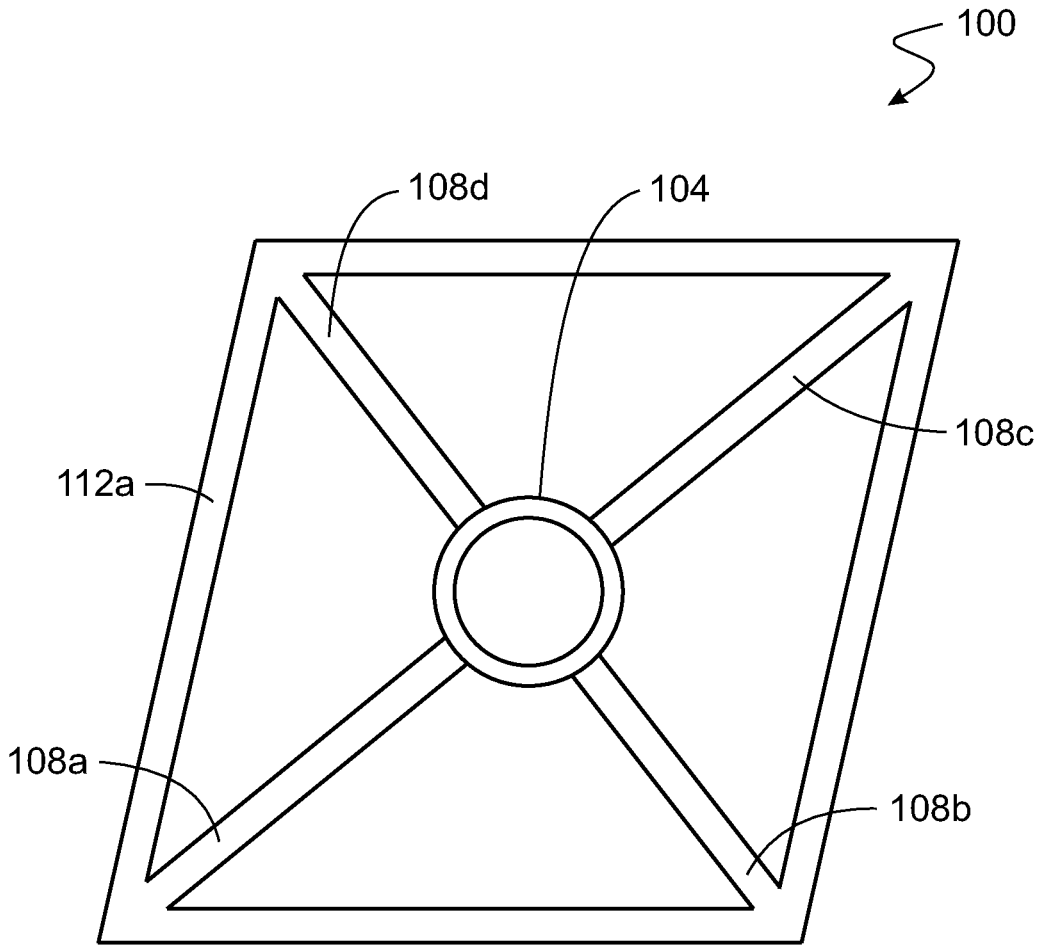
Figure 1D:
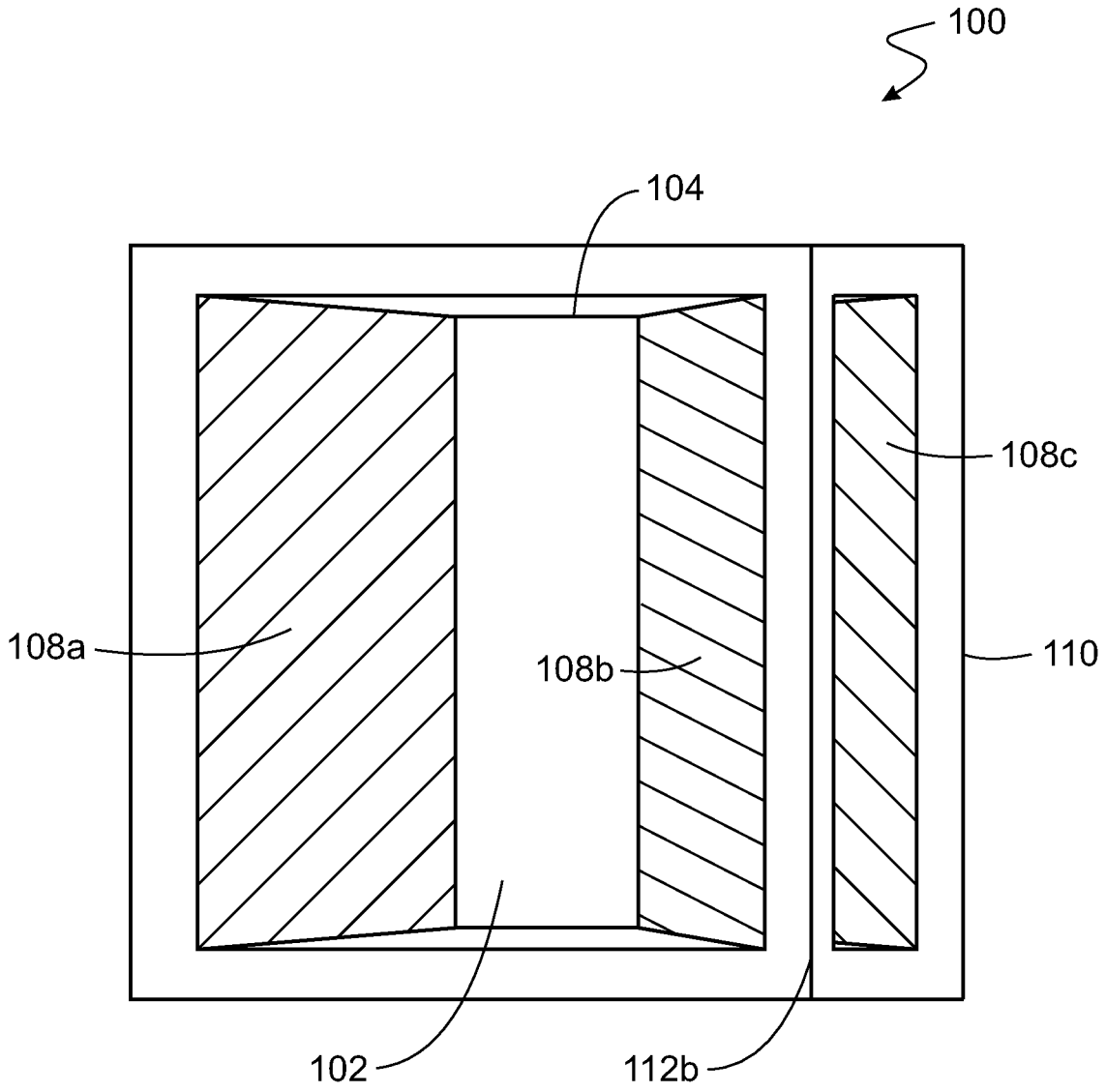
Figure 2A:
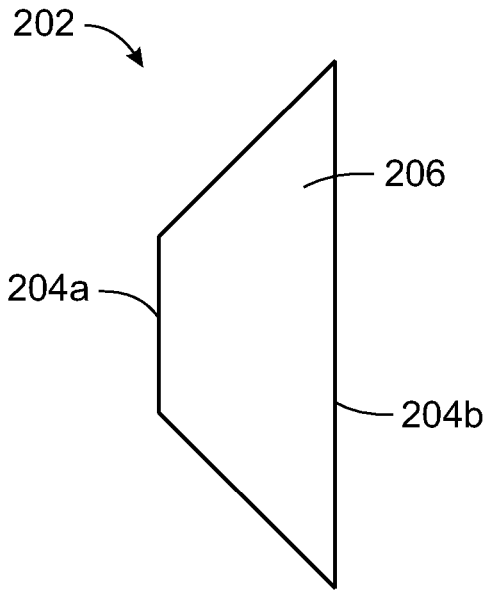
FIGS. 2A and 2B are views of examples of components of open frame foundation apparatus.
Figure 2B:
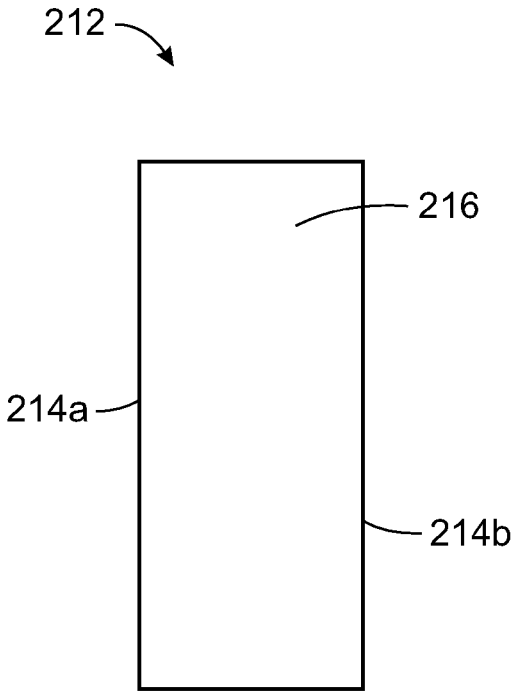

FIGS. 1A, 1B, 1C and 1D are, respectively, an isometric view, a perspective view, a top view and a side view of an implementation of the apparatus 100. FIG. 1B schematically shows the apparatus 100 positioned under the ground 120 with a tubular portion 122 positioned in the tube 102 and extending above the ground 120. The tubular portion 122 is the portion of the structure to be vertically supported by the apparatus 100. In the implementation shown schematically in FIGS. 1A-1D, the apparatus 100, specifically, the prism member 110 has an angular structure, i.e., is a right-angle rhombus prism. The top view (FIG. 1C) shows the rhombus cross-section of the prism 110. The side view (FIG. 1D) shows that the rhombus is a right-angle rhombus. The side faces of the prism member 110 (i.e., the faces parallel to the tube 102) can be rectangular (e.g., square). The quadrilateral prism member 110 can have alternative angular structures (i.e., with non-zero, non-90 degree angles between at least connected edges that form a face that is perpendicular to the tube 102). A benefit of an angular structure is the availability of additional surface area to transfer forces on the supported structures to soil in which the apparatus 100 is buried.

FIGS. 3A-3D are views of an example of an open frame foundation apparatus 300. FIGS. 3A, 3B, 3C and 3D are, respectively, an isometric view, a perspective view, a top view and a side view of an implementation of the apparatus 100. FIG. 3B schematically shows the apparatus 300 positioned under the ground 320 with a tubular portion 322 positioned in the tube 302 and extending above the ground 320. The tubular portion 322 is the portion of the structure to be vertically supported by the apparatus 300. In the implementation shown schematically in FIGS. 3A-3D, the apparatus 300, specifically, the prism member 310 has right-angular structure, i.e., is a right-angle rectangular prism such as a cuboid. The top view (FIG. 3C) shows the rectangular cross-section of the prism 310. The side view (FIG. 3D) shows that the prism is a right-angle rectangular prism or cuboid. The side faces of the prism member 310 (i.e., the faces parallel to the tube 302) can be rectangular (e.g., square). A benefit of a structure with right angles is case of construction.

In some implementations, the prism member can have a circular cross-section instead of a quadrilateral cross-section. For example, the prism member can have a right-angle cylinder. In such implementations, the edge of the prism member can be curved. In some implementations, the apparatus 100 can be formed to be taller than it is wide. Such implementations can be beneficial when the structure to be supported is buried. The taller-than-wide geometry in such implementations can allow supporting taller structures compared to a geometry in which the apparatus is as tall as it is wide. In some implementations, the apparatus 100 can be formed to be wider than it is tall. Such implementations can be beneficial when the apparatus is placed above ground and the structure to be supported need not be buried. The wider-than-tall geometry can provide greater support to above-ground structures compared to a geometry in which the apparatus is as wide as it is tall.

In some implementations, holes can be formed in the outer wall of the tube. The holes can be used to fasten the outer wall of the tubular portion of the structure to be supported to the tube of the apparatus. For example, holes can be formed in the outer wall of the tubular portion as well. Fasteners, e.g., screws, rivets or other fasteners, can be inserted through the outer wall of the tube and the outer wall of the structure's tubular portion to fasten the two structures to each other. The use of fasteners passed through holes in the tube can further strengthen the support that the apparatus gives to the structure.

Each component of the apparatus 100 (FIGS. 1A-1D) or the apparatus 300 (FIGS. 3A-3D) can be made using any non-metallic material that is resistive to degradation. In some implementations, each component can be made using fiber-reinforced polymer, e.g., glass fiber reinforced polymer, carbon fiber reinforced polymer, aramid fiber reinforced polymer, natural fiber reinforced polymer, to name a few. In some implementations, the apparatus can include a pultruded FRP inner part that includes the tube and fin members, which can be fastened to the pultruded FRP prism member. In some implementations, the fasteners and associated components (e.g., screws, washers, nuts, and the like) passed through the holes in the tube to fasten the apparatus to the structure can be metallic. Implementations of the apparatus are described as having quadrilateral prism members. The apparatus can have prism members with other geometrical cross-sections that, in general, can resist lateral forces that would cause the apparatus to rotate when installed below ground.

Figure 4:
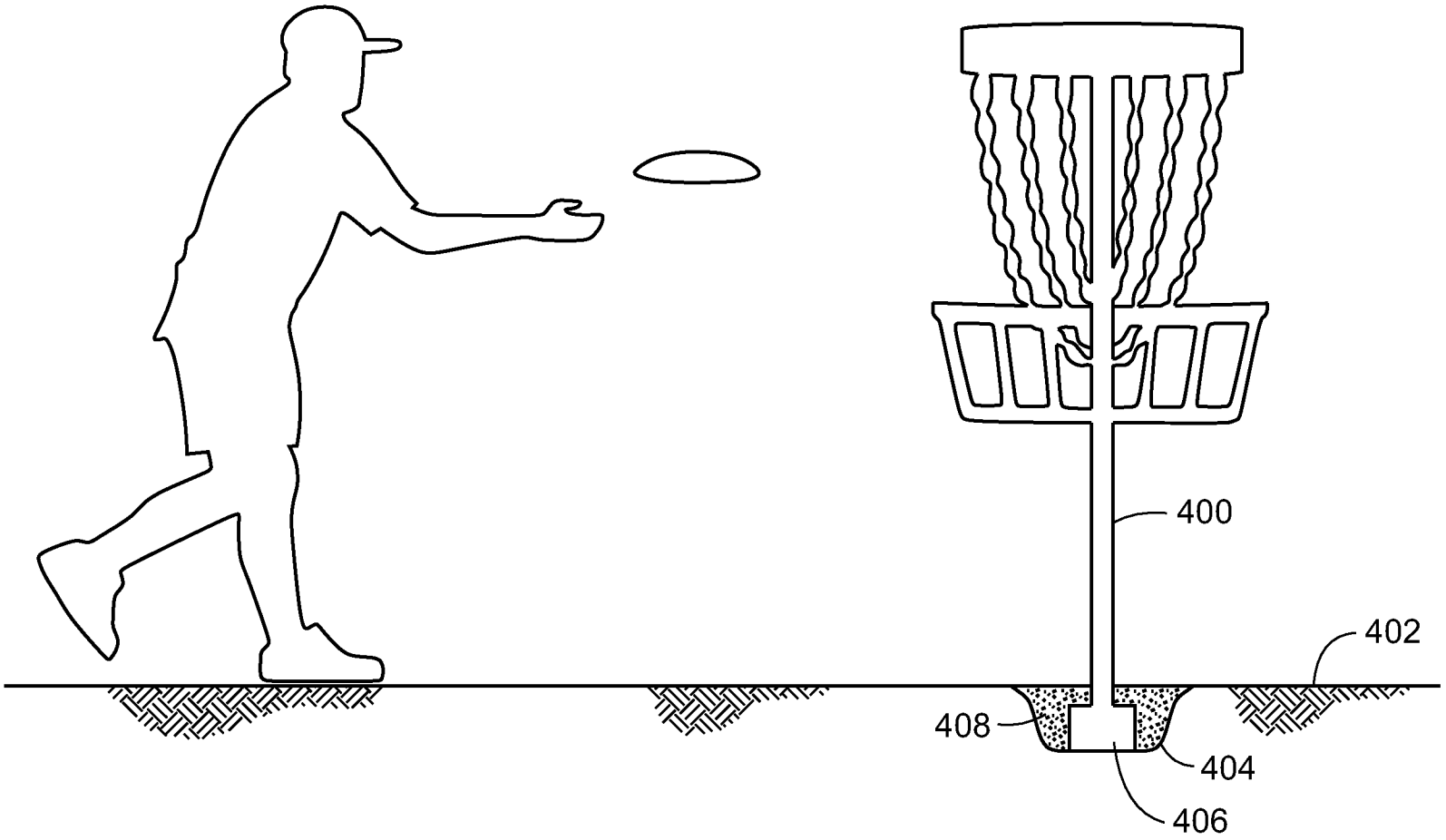
FIG. 4 is a schematic diagram of an example of an application of the open frame foundation apparatus of FIGS. 1A-1D or FIGS. 3A-3D.

FIG. 4 is a schematic diagram of an example of an application of the open frame foundation apparatus of 100 (FIGS. 1A-1D) or 300 (FIGS. 3A-3D). The apparatus 100/300 is used to support a structure 400, i.e., to assist the structure 400 to be vertically oriented perpendicular to the ground 402 and to withstand any forces that can cause the structure 400 to deviate from the supported orientation. As schematically shown in FIG. 4, a hole 404 can be dug in the ground 402, and an apparatus 406 (which is identical to either the apparatus 100 or the apparatus 300) can be positioned in the hole 404. The structure 400 (e.g., a disc golf basket, as schematically shown in FIG. 4) can be inserted into the apparatus 406. For example, an end of a tubular portion of the structure 400 can be inserted within the tube of the apparatus 406. The depth of the hole 406 can be selected based on a height of the structure 400 and/or based on a height of the apparatus 406, specifically, based on a length of the tube that is oriented perpendicular to the ground 402. The hole 406 can be filled with soil 408, e.g., cohesionless, non-sticky soil such as sand, fine gravel, or a mixture of both.

Figure 5:
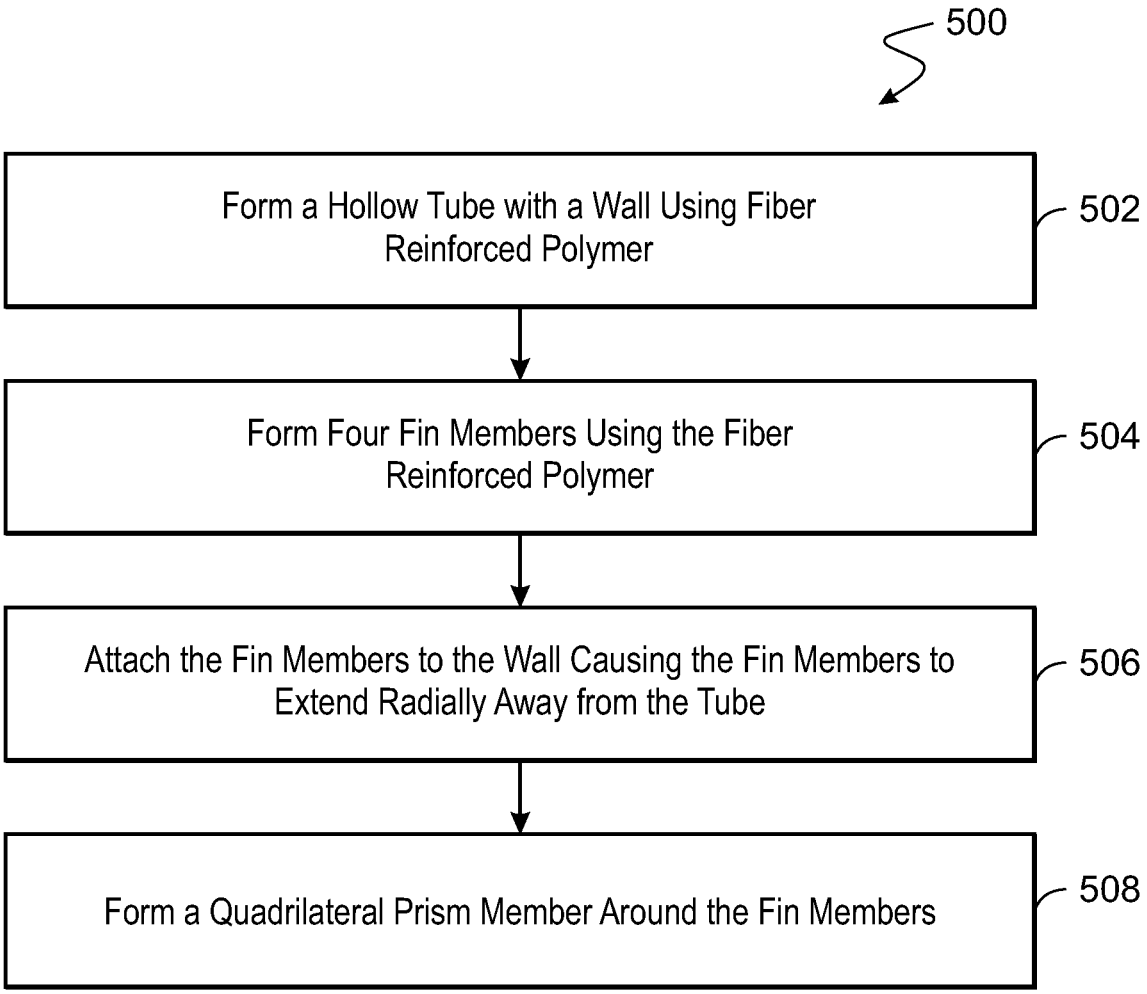
FIG. 5 is a flowchart of an example of a process to make an open frame foundation apparatus.

FIG. 5 is a flowchart of an example of a process 500 to make an open frame foundation apparatus. The apparatus described with reference to the process 500 can be the apparatus 100 (FIGS. 1A-1D) or the apparatus 300 (FIGS. 3A-3D). At 502, a hollow tube with a wall is formed using fiber reinforced polymer. At 504, four fin members are formed using fiber reinforced polymer. At 506, the fin members are attached to the wall causing the fin members to extend radially away from the tube. At 508, a quadrilateral prism member is formed using fiber reinforced polymer and around the fin members.

Figure 6:
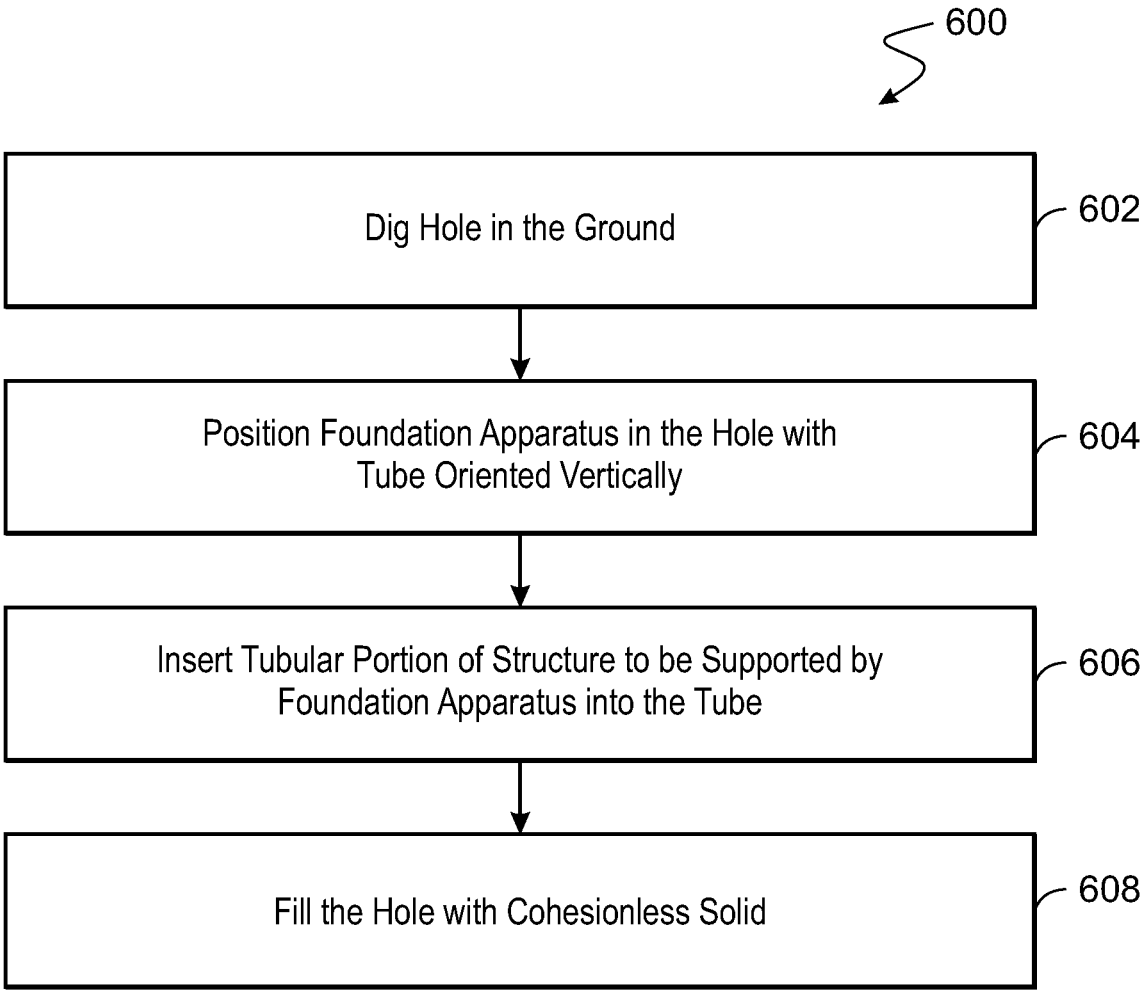
FIG. 6 is a flowchart of an example of a process to use an open frame foundation apparatus.

FIG. 6 is a flowchart of an example of a process 600 to use an open frame foundation apparatus. The apparatus described with reference to the process 500 can be the apparatus 100 (FIGS. 1A-1D) or the apparatus 300 (FIGS. 3A-3D) or the apparatus 400 (FIG. 4). At 602, a hole is dug in the ground. At 604, the apparatus is positioned in the hole with the tube oriented vertically, i.e., perpendicular to the ground. At 606, a tubular portion of a structure to be supported is inserted into the tube of the apparatus. At 608, the hole is filled with cohesionless solid.

Thus, particular implementations of the subject matter have been described. Other implementations are within the scope of the following claims.

The invention claimed is:

1. An apparatus comprising:

a hollow tube comprising a wall having an outer surface;

four fin members, each fin member having a quadrilateral shape, wherein a respective first edge of each fin member is attached to the outer surface of the wall of the hollow tube, and each fin member extends radially away from the outer surface of the wall of the hollow tube; and a quadrilateral prism member surrounding the hollow tube and the four fin members, wherein a second edge of each fin member is attached to a corresponding edge of the quadrilateral prism member, wherein two adjacent fin members are connected by two other edges of the quadrilateral prism member.

2. The apparatus of claim 1, wherein the hollow tube, the four fin members and the quadrilateral prism member are made from fiber-reinforced polymer.

3. The apparatus of claim 1, wherein each fin member is attached on the outer surface of the wall at 90 degree offsets from each other.

4. The apparatus of claim 1, wherein each fin member has a rectangular shape, wherein the first edge of each fin member is of the same length as the second edge of each fin member.

5. The apparatus of claim 1, wherein each fin member has a trapezoidal shape, wherein the first edge of each fin member is shorter in length than the second edge of each fin member.

6. The apparatus of claim 5, wherein a length of the tube is less than a height of the quadrilateral prism member.

7. The apparatus of claim 1, wherein the quadrilateral prism member is a right angle, rhombus prism.

8. The apparatus of claim 1, wherein the quadrilateral prism is a right angle, rectangular prism.

9. An apparatus comprising:

a hollow tube comprising a wall having an outer surface;

four fin members, each fin member having a quadrilateral shape, wherein a respective first edge of each fin member is attached to the outer surface of the wall of the hollow tube, and each fin member extends radially away from the outer surface of the wall of the hollow tube; and a quadrilateral prism member surrounding the hollow tube and the four fin members, wherein a second edge of each fin member is attached to a corresponding edge of the quadrilateral prism member, wherein two adjacent fin members are connected by two other edges of the quadrilateral prism member, wherein faces of the quadrilateral prism are void of material.

10. A method comprising:

forming a hollow tube comprising a wall using fiber reinforced polymer;

forming four fin members using the fiber reinforced polymer, each fin member formed in a quadrilateral shape;

attaching a respective first edge of each fin member to the outer surface of the wall of the hollow tube such that each fin member extends radially away from the outer surface of the wall of the hollow tube; and forming a quadrilateral prism member surrounding the hollow tube and the four fin members by:

attaching a second edge of each fin member to a corresponding edge of the quadrilateral prism member made using the fiber reinforced polymer, and attaching two adjacent fin members of the quadrilateral prism member to two other edges of the quadrilateral prism member, each of the two other edges made using the fiber reinforced polymer.

11. The method of claim 10, wherein attaching the respective first edge of each fin member to the outer surface of the wall of the hollow tube comprises attaching each fin member on the outer surface of the wall at 90 degree offsets from each other.

12. The method of claim 10, wherein each fin member is formed in a rectangular shape, wherein the first edge of each fin member is of the same length as the second edge of each fin member.

13. The method of claim 10, wherein each fin member is formed in a trapezoidal shape, wherein the first edge of each fin member is shorter in length than the second edge of each fin member.

14. The method of claim 13, wherein the tube is formed to a length less than a height of the quadrilateral prism member.

15. The method of claim 10, further comprising:

positioning the quadrilateral prism member on the ground, the tube oriented vertically with reference to the ground; and inserting, into the tube, a tubular portion of a structure to be anchored to the earth at a location of the quadrilateral prism.

16. The method of claim 15, wherein positioning the quadrilateral prism member on the ground comprises:

digging a hole in the ground; and positioning the quadrilateral prism member within the hole, the tube oriented vertically within the hole, wherein the method further comprises packing the hole with cohesionless soil.

17. The method of claim 15, wherein the structure is a disc golf basket.

* * * * *